US008917575B2

(12) United States Patent
Peters

(10) Patent No.: US 8,917,575 B2
(45) Date of Patent: Dec. 23, 2014

(54) DEVICE FOR GENERATING PRESSURE PULSES IN FLOWING FLUID AND METHOD FOR THE SAME

(75) Inventor: Volker Peters, Wienhausen (DE)

(73) Assignee: Baker Hughes Incorporated, Houston, TX (US)

( * ) Notice: Subject to any disclaimer, the term of this patent is extended or adjusted under 35 U.S.C. 154(b) by 498 days.

(21) Appl. No.: 13/402,447

(22) Filed: Feb. 22, 2012

(65) Prior Publication Data

US 2013/0215718 A1 Aug. 22, 2013

(51) Int. Cl.
*E21B 47/18* (2012.01)

(52) U.S. Cl.
CPC ..... *E21B 47/187* (2013.01); *E21B 47/18* (2013.01)
USPC ..... 367/85; 175/48

(58) Field of Classification Search
CPC ..... E21B 47/187; E21B 47/18; E21B 47/182; E21B 21/08; E21B 34/10
USPC ..... 367/85, 83; 175/48; 166/321, 319
See application file for complete search history.

(56) References Cited

U.S. PATENT DOCUMENTS

| | | | | |
|---|---|---|---|---|
| 5,103,430 | A | 4/1992 | Jeter et al. | |
| 5,787,052 | A | 7/1998 | Gardner et al. | |
| 6,484,817 | B2 | 11/2002 | Innes | |
| 6,626,253 | B2 | 9/2003 | Hahn et al. | |
| 6,898,150 | B2 | 5/2005 | Hahn et al. | |
| 7,139,219 | B2 * | 11/2006 | Kolle et al. | 367/85 |
| 7,250,873 | B2 | 7/2007 | Hahn et al. | |
| 7,417,920 | B2 * | 8/2008 | Hahn et al. | 367/85 |
| 7,429,934 | B2 | 9/2008 | Sim et al. | |
| 7,564,741 | B2 | 7/2009 | Pratt et al. | |
| 7,617,874 | B2 * | 11/2009 | Ocalan | 166/321 |
| 7,719,439 | B2 | 5/2010 | Pratt et al. | |
| 8,020,632 | B2 | 9/2011 | Moriarty | |
| 8,684,093 | B2 * | 4/2014 | Segura et al. | 166/374 |
| 2010/0157735 | A1 | 6/2010 | Allan et al. | |
| 2011/0011594 | A1 | 1/2011 | Young et al. | |

FOREIGN PATENT DOCUMENTS

GB 2473334 A 3/2011

OTHER PUBLICATIONS

Notification of Transmittal of the International Search Report and the Written Opinion of the International Searching Authority, or the Declaration; PCT/US2013/026852; Jun. 10, 2013.
D. Pixton et al., "Advanced Mud Hammer Systems", Novatek, Inc.; retrieved from http://www.netl.doe.gov/KMD/cds/Disk32/ng3B-5.pdf on Dec. 8, 2011; Google indicates 2002 publication; 16 pages.

* cited by examiner

*Primary Examiner* — John A Tweel, Jr.
(74) *Attorney, Agent, or Firm* — Cantor Colburn LLP

(57) ABSTRACT

A device for generating pressure pulses in flowing fluid includes a valve having a stem movable linearly relative to a passageway. The valve is configured to vary restriction to flow through the passageway in response to changes in relative position between the stem and the passageway. The device also includes a rotatable member in operable communication with the valve such that rotation of the rotatable member causes the stem to move, and a motion translation arrangement that is in operable communication with the rotatable member and the stem such that the stem linearly reciprocates in response to the rotatable member rotating in a single direction of rotation.

19 Claims, 8 Drawing Sheets

DEVICE FOR GENERATING PRESSURE PULSES IN FLOWING FLUID AND METHOD FOR THE SAME

BACKGROUND

Tubular systems capable of generating pressure pulses in flowing fluid are sometimes used for communication purposes. In the downhole industry, for example, drilling fluid (or mud) pulse telemetry allows for communication between downhole and surface. Some such systems employ rotary motors that drive ball screws in alternate directions to vary restriction of a valve. The motor must necessarily stop and reverse directions to cause the valve to switch between decreasing and increasing restriction, for example, in the process of generating pressure pulses in the flowing fluid. Although such systems serve the purpose for which they are intended, significant power is expended in overcoming inertia of rotating parts that does not directly contribute to generation of the pressure pulses. Devices and methods that reduce the inefficiencies associated with systems as that described above are always welcome in the field.

BRIEF DESCRIPTION

Disclosed herein is a device for generating pressure pulses in flowing fluid. The device includes a valve having a stem movable linearly relative to a passageway. The valve is configured to vary restriction to flow through the passageway in response to changes in relative position between the stem and the passageway. The device also includes a rotatable member in operable communication with the valve such that rotation of the rotatable member causes the stem to move, and a motion translation arrangement that is in operable communication with the rotatable member and the stem such that the stem linearly reciprocates in response to the rotatable member rotating in a single direction of rotation.

Further disclosed herein is a method of generating pressure pulses in flowing fluid. The method includes rotating a rotatable member about an axis in a single direction of rotation, reciprocating a stem linearly with the rotation, varying restriction to flow through a passageway with the stem, adjusting a motion translation arrangement, and altering a maximum restriction to flow.

Also disclosed herein is another method of generating pressure pulses in flowing fluid. The method includes, rotating a rotatable member about an axis in a first direction of rotation, linearly moving a stem in a first direction with the rotation, rotating the rotatable member about the axis in a second direction of rotation, linearly moving the stem in a second direction with the rotation, varying restriction to flow through a passageway with the stem, adjusting a motion translation arrangement, and altering a maximum restriction to flow.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
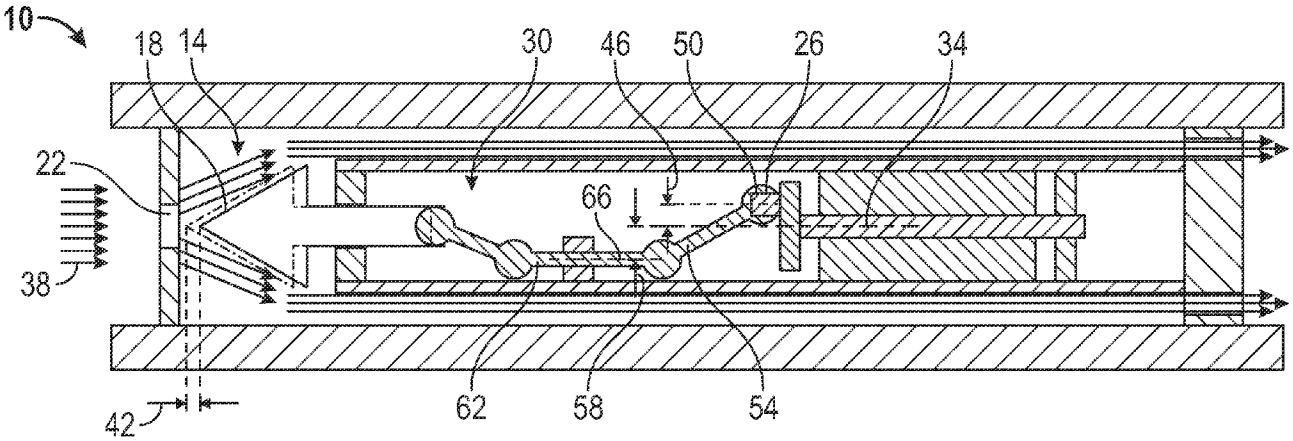
FIG. 1A depicts a partial cross sectional view a device for generating pressure pulses in flowing fluid illustrated in a configuration to generate a minimum pressure pulse.
Figure 1B:
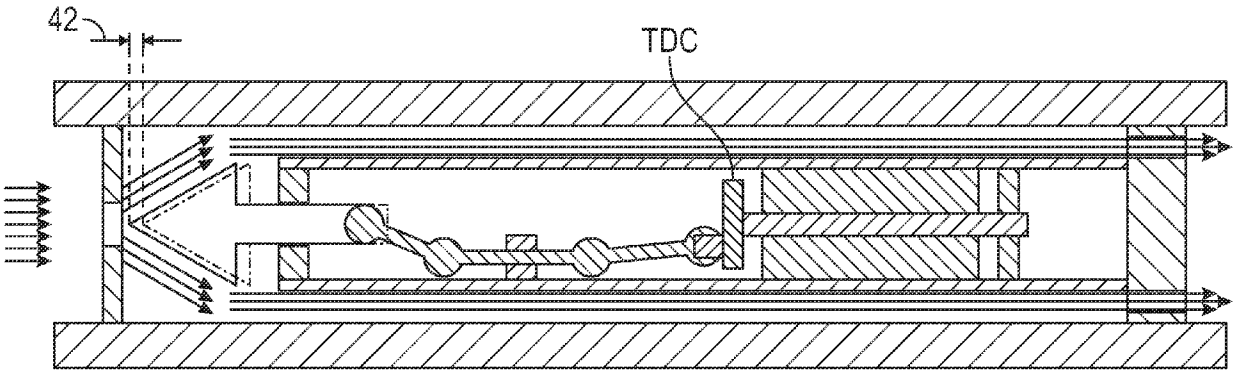
FIG. 1B depicts a partial cross sectional view of the device of FIG. 1A illustrated in a maximum restriction configuration to generate a maximum pressure pulse.

Referring to FIGS. 1A and 1B an embodiment of a device for generating pressure pulses in flowing fluid is illustrated generally at 10. The device 10 includes, a valve 14 having a stem 18 that is linearly movable relative to a fluid flow passageway 22 (with linearly herein meaning movable along a straight line). The valve 14 is positioned and oriented relative to the passageway 22 to vary restriction to fluid flow through the passageway 22 in response to changes in relative position between the stem 18 and the passageway 22 caused by the linear movement of the stem 18. A driven rotatable member 26 drives the valve 10 and rotates in a single direction of rotation. A motion translation arrangement 30 causes the stem 18 to move linearly substantially parallel to a rotational axis 34 of the rotatable member 26 in response to rotation of the rotatable member 26. The foregoing structure causes pressure in the flow stream 38 to vary in proportion to an amount of restriction to flow through the passageway 22 generated by positions of the stem 18 relative thereto. One will appreciate that pressure pulses are detectable upstream of the device 10 as they propagate through flowing fluid.

A stroke length 42 of the stem 18 (the difference in position of the stem 18 when in the least restrictive position as shown in FIG. 1 and the most restrictive position as shown in FIG. 2) is determined by two factors. First is a radial dimension 46 of the rotatable member 26; as measured relative to the rotational axis 34. Note the radial dimension 46 is measured from the axis 34 to where an end 50 of a first link 54 of the motion translation arrangement 30 is attached to the rotatable member 26. All other things being equal the larger the radial dimension 26 is the larger the stroke length 42 will be. Second is a radial displacement 58 of a second link 62 (that moves parallel to the rotational axis 34) of the motion translation arrangement 30. The radial displacement 58 is the radial dimension from the rotational axis 34 to a path 66 along which the link 62 moves. As such in the foregoing device 10, the stem 18 is moved to the least restrictive position (its rightward most position as shown in FIG. 1A) when the rotatable member 26 is exactly opposite from the second link 62 with the rotational axis 34 aligned exactly therebetween. Conversely, the stem 18 is moved to the most restrictive position (its leftward most position as shown in FIG. 1B) when the rotatable member 26 is exactly aligned with the second link 62 (i.e. is on the same side of the rotational axis 34).

The greatest forces on the stem 18 occur when the valve 14 is providing the maximum restriction to flow through the passageway 22. The instant invention minimizes torque required to rotate the rotatable member 26 through this maximum force location by having it occur at or in any reasonable proximity to what may be referred to as top-dead-center (TDC) of travel of the rotatable member 26. Alternately, by adding an additional linkage (not shown) for example, the relationship between the valve 14 being positioned at maximum restriction and rotational position of the rotatable member 26 can be reversed such that the maximum restriction occurs when the rotatable member 26 is at the exact opposite position that may be referred to as bottom-dead-center (BDC). This configuration essentially provides a varying leverage between rotation of the rotatable member 26 and linear movement of the stem 18 as the rotatable member 26 rotates through one half of one complete rotation. The variable leverage according to this invention may be used to minimize the necessary mechanical torque, power, speed, etc. to operate devices as described herein. The exact positions of the drive described in this application may be tuned to fit a certain purpose; exactly named positions are exemplary only to understand the basic idea. Hence tuning the device to other (intermediate) positions may serve another purpose and are not excluded herewith. (Stated another way, a relationship between movement of the stem 18 and angles of rotation of the rotatable member 26 is not a linear relationship). The most amount of leverage between the rotatable member 26 and the forces applied to the stem 18 therefrom occur when the stem 18 is in either the TDC or the BDC. The least amount of leverage between the rotatable member 26 and the forces applied to the stem 18 therefrom occur when the stem 18 is located someone between the TDC and the BDC.

The foregoing configuration assures that power required to rotate the rotatable member 26 to generate pulses in the fluid stream are minimized when setup in an appropriate way. Forces applied to the stem 18 from the rotatable member 26 at either TDC or BDC are effectively infinite. Additionally, the leverage of forces applied to the stem 18 from the rotatable member 26 vary continuously as a function of the rotational position of the rotatable member 26 and other geometrical sizes of the attached linkage 54 and 62. Additionally, since the rotatable member 26 only rotates in a single direction, inertia of the rotating components is maintained while the pulsing takes place. This is completely counter to typical systems that employ motors and ball screws, for example, to drive a restriction device. In such systems, movement of the motor and the ball screw must be halted and the direction of motion reversed each time the restriction reaches a maximum or a minimum. Doing so requires reversing inertia and momentum of a significant portion, if not all, of the moving parts of the assembly, requiring more work in the process.

Figure 2A:
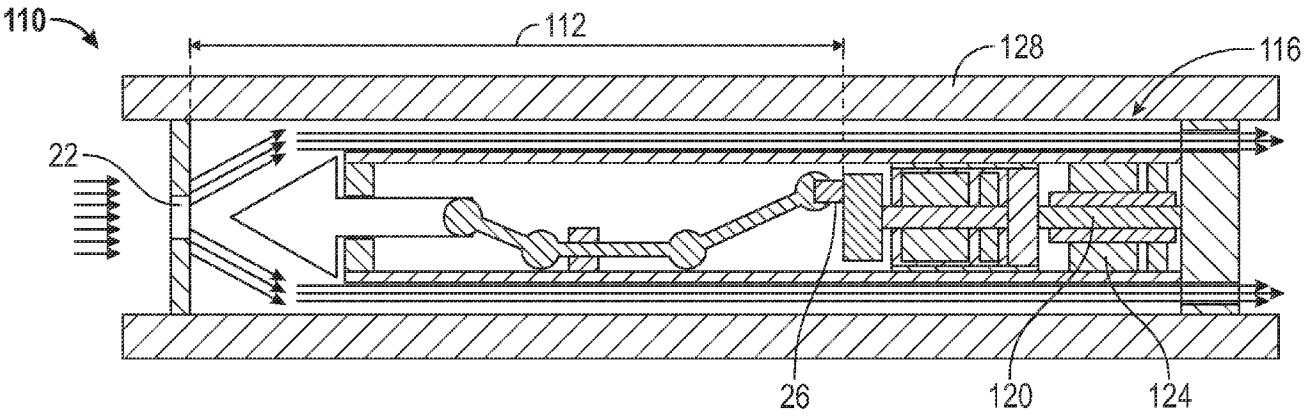
FIG. 2A depicts a partial cross sectional view of an alternate device for generating pressure pulses in flowing fluid illustrated in a configuration to generate a minimum pressure pulse.
Figure 2B:
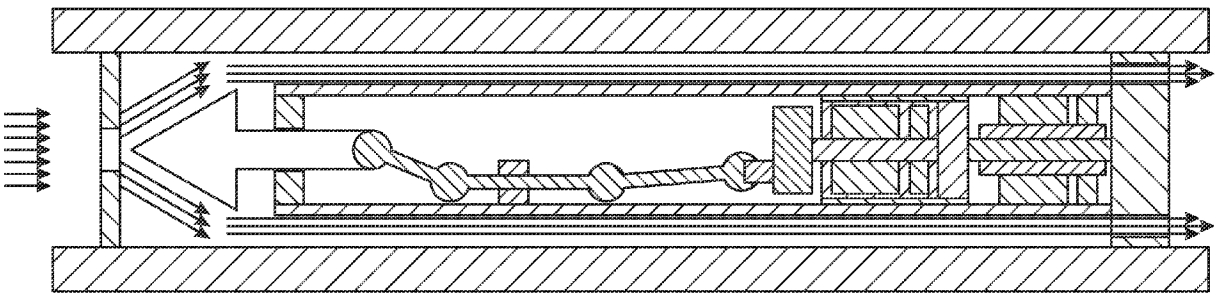
FIG. 2B depicts a partial cross sectional view of the device of FIG. 2A illustrated in a maximum restriction configuration to generate a maximum pressure pulse.

Referring to FIGS. 2A, 2B, 3A, 3B, 6 and 7 for someone familiar with methods of mud pulse telemetry, for example, it becomes clear that fixed valve positions for open and closed cannot be used over a wide span of operational conditions. In other words the device would have to be adjusted for a limited operational window with respect to mud flow, mud density and encoding pressure prior to the deployment. Devices 110, 210 and 410 of embodiments disclosed herein overcome these limitations. One part of these embodiments serves for an offset with respect to operative conditions and desired encoding strength. Electronics hooked up to drive such a system may be able to determine operating parameters like flow and mud density in order to adjust an actuator 116, such as the spindle drive actuator illustrated herein, prior to (or during) operation of the devices 110, 210, 410. As a result, a reasonable encoding strength (pressure pulse) is established over a wide range of operating conditions. Referring specifically to FIGS. 2A and 2B the device 110 differs from the device 10 in that the device 110 incorporates adjustability of a longitudinal dimension 112 between the rotatable member 26 and the passageway 22. This adjustability is provided by the actuator 116 although any mechanism capable of displacing a first portion 120 relative to a second portion 124 of the actuator 116 could be employed. In this embodiment the second portion 124 is attached to a structure 128 as is the passageway 22 while the first portion 120 and the rotatable member 26 are movable relative to the structure 128. As such, when the actuator 116 is actuated movement of the first portion 120 relative to the second portion 124 causes a change in the longitudinal dimension 112. Since, in this embodiment, the stroke length 42 is constant regardless of the longitudinal dimension 112, changing the longitudinal dimension 112 causes all distances between the stem 18 and the passageway 22 to be adjusted by this same amount. This adjustability allows an operator or preferably the device itself to automatically set how much restriction, and pressure increase, is attained when the stem 18 is positioned at the most restrictive position (FIG. 2B). The automatic adjustment could be designed into the devices 10, 110, 210, 310 and 410 disclosed herein, and could automatically adjust the maximum restriction condition to cause pressure, for example, upstream of the passageway 22 to fall within a selected range.

Figure 3A:
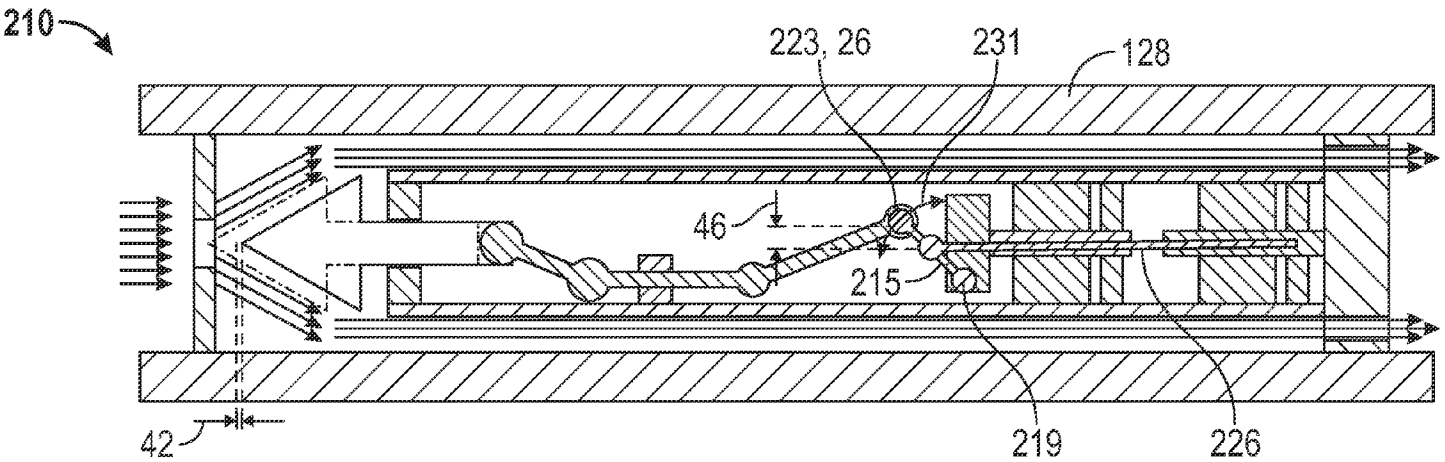
FIG. 3A depicts a partial cross sectional view of an alternate device for generating pressure pulses in flowing fluid illustrated in a configuration to generate a minimum pressure pulse.
Figure 3B:
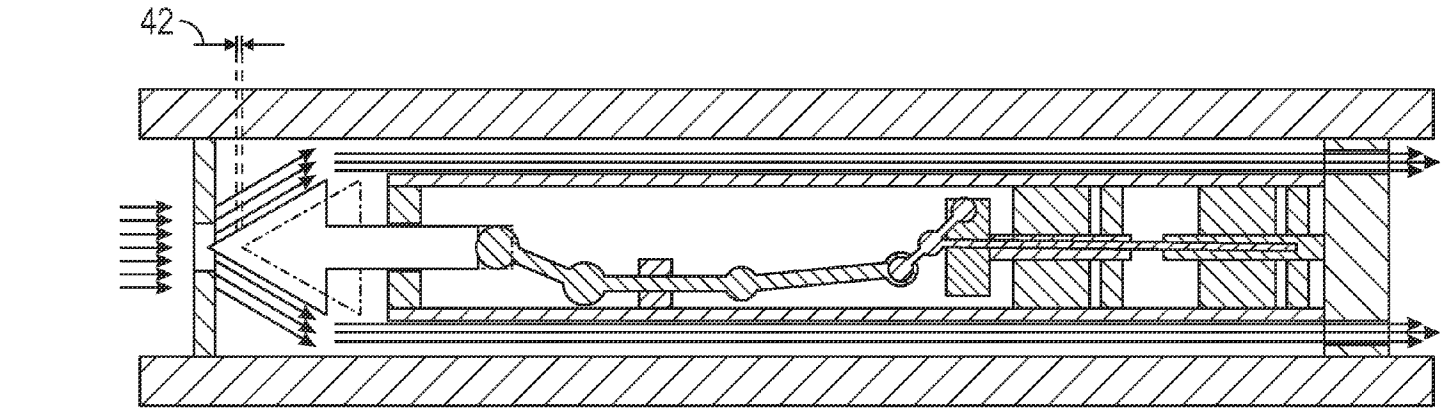
FIG. 3B depicts a partial cross sectional view of the device of FIG. 3A illustrated in a maximum restriction configuration to generate a maximum pressure pulse.

Referring specifically to FIGS. 3A and 3B the device 210 provides a level of adjustability not included in either the device 10 or 110. The device 210 allows an operator to adjust the stroke length 42. This adjustability is made possible by a third link 215 that has two ends; a pivot end 219 and a displaceable end 223. An arm 226, attached about midway between the ends 219 and 223, is movable relative to the structure 128 to cause the third link 215 to pivot about the pivot end 219. Doing so causes the displaceable end 223 (which in this embodiment is also the rotatable member 26) to move through an arc 231 thereby altering the radial dimension 46. Since changes in the radial dimension 46 cause the stroke length 42 to change, this embodiment provides an operator or the device itself the ability to easily or automatically alter the stroke length 42. The automatic adjustment could be designed into the devices 10, 110, 210, 310 and 410 disclosed herein, and could automatically adjust the maximum and minimum restriction conditions to cause maximum and minimum pressure values upstream of the passageway 22, for example, to fall within selected ranges.

Alternate embodiments could include both the adjustability of the longitudinal dimension 112 and thus a maximum restriction condition and the stroke length 42 in a single device.

Figure 4:
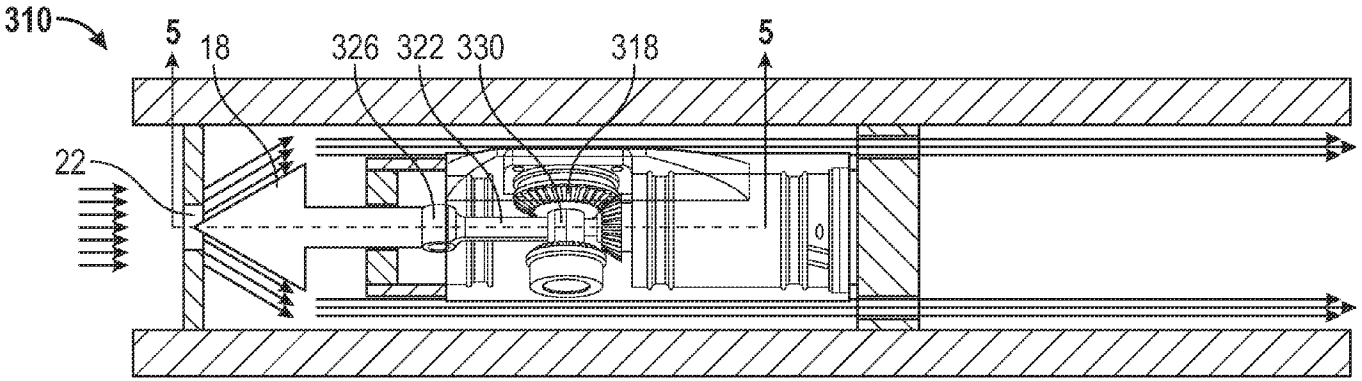
FIG. 4 depicts a partial cross sectional view of an alternate device for generating pressure pulses in flowing fluid.
Figure 5:
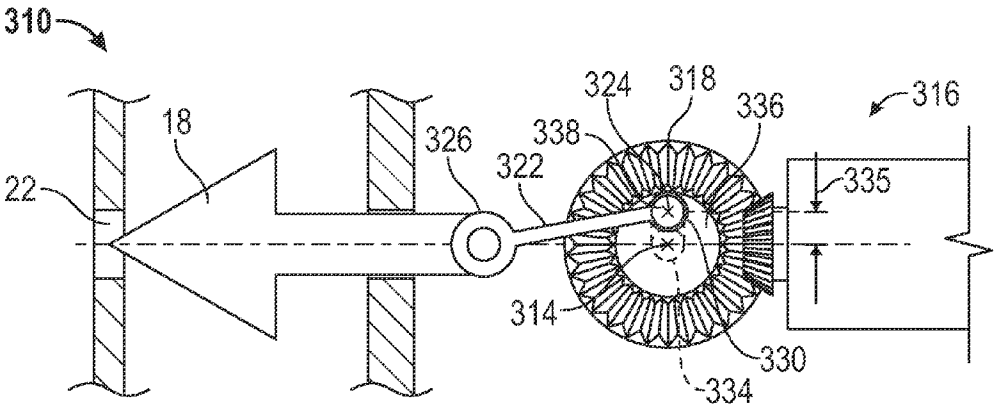
FIG. 5 depicts a magnified partial cross sectional view of the device of FIG. 4 taken at arrows 5-5.

Referring to FIGS. 4 and 5, another embodiment of a device for generating pressure pulses in flowing fluid is illustrated at 310. A primary difference between the device 310 and the other embodiments disclosed is an orientation of an axis 314 of rotatable member 318. The axis 314 is oriented perpendicular to linear motion of the stem 18. A link 322 is attached at a first end 326 to the stem 18 and at a second end 330 to a crankshaft 334. The crankshaft 334 rotates with the rotatable member 318 driven by an actuator 316. A bearing 324 at a rotational center 338 of the second end 330 is eccentric to the axis 314 thereby defining a radial dimension 335 of a radial offset 336 creating an oscillating linear motion of the first end 326 and the stem 18 in response to rotation of the rotatable member 318. The stem 18 is moved toward the passageway 22 (leftward in the Figures) and away from the passageway 22 (rightward in the Figures) according to a direction that the rotational center 338 is displaced from the axis 314. While the axis 314 is oriented perpendicular to the linear motion of the stem 18 the leverage applied to the stem 18 as a function of rotational orientation of the rotating member 318 is similar to that of the other embodiments disclosed, as is the fact that the rotatable member 318 rotates in a single direction throughout the generation of pressure pulses in the fluid.

It should be noted that the device 310 can incorporate features so that the device 310 has affective adjustability similar to that described in FIGS. 2A and 2B with reference to the device 110. Similarly the device 310 can incorporate a secondary device so that the device 310 has affective adjustability similar to that described in FIGS. 3A and 3B with reference to the device 110.

Additionally, any of the devices 110, 210, 310 or 410 could be operated such that their respective rotatable members 26 and 318 are rotationally reversible. Although such an embodiment would require stopping to reverse the rotational direction of the rotatable members 26, 318 doing so is fully within the capability of the embodiments disclosed herein. Doing so would necessarily cause the stem 18 to reverse its direction of linear motion.

Figure 6:
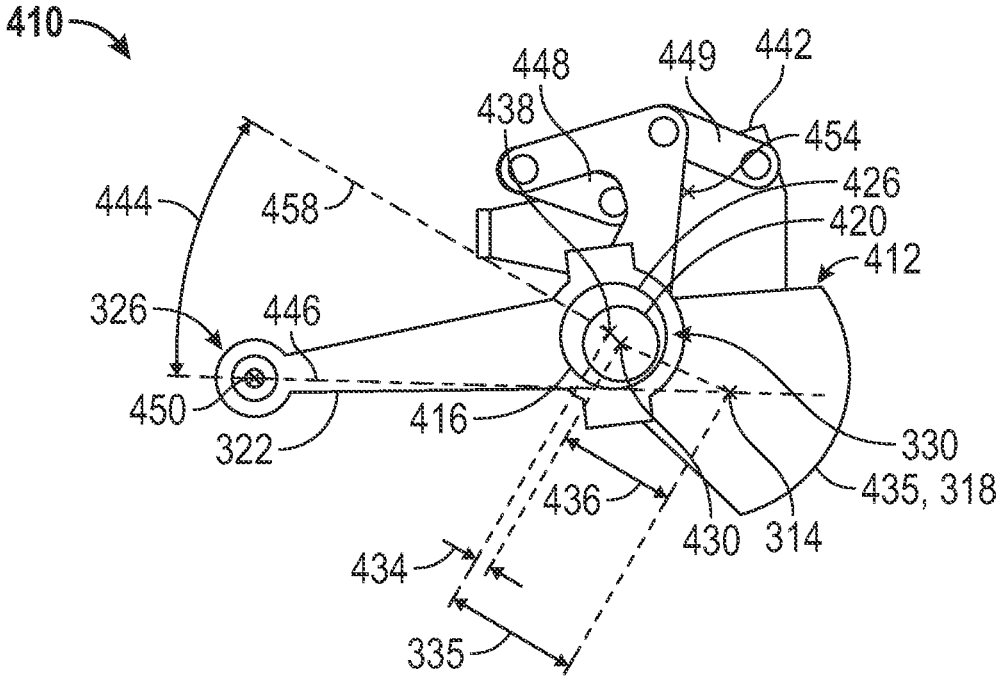
FIG. 6 depicts a partial side view of an portion of an alternate embodiment of a device for generating pressure pulses in flowing fluid.

Referring to FIG. 6, another embodiment of a portion of a device for generating pressure pulses in flowing fluid is illustrated at 410. The device 410 differs from the device 310 in that a stroke motion translation arrangement 412 is employed for adjusting a radial offset 436 of the device 410. As described in reference to FIG. 5 the link 322 is attached at the first end 326 to the stem 18 and at the second end 330 to a main crankshaft 435. In this embodiment the main crankshaft 435 and the rotatable member 318 are the same part and thus rotate as one. The motion translation arrangement 412 includes an eccentric member 416 that has an inner bearing 420 and an outer bearing 426. The inner bearing 420 has a center 430 that is displaced by an eccentric dimension 434 from a center 438 of the outer bearing 426. A linking structure 442 maintains a directional orientation 444 of the eccentric dimension 434 relative to a line 446 passing through the axis 314 and a center 450 of the first end 326. The foregoing structure allows an operator to effectively adjust the radial offset 436 of the device 310 by altering the directional orientation 444 by simply altering an anchoring point 454 of the linking structure 442 relative to the axis 314.

Stated another way, the radial offset 436 is defined by more than simply the radial dimension 335 of the crankshaft 334 as is the case for the radial offset 336 in the device 310. Instead, the radial offset 436 is defined in part by the radial dimension 335 and in part by the eccentric dimension 434. When the eccentric dimension 434 is aligned with a radial line 458 that passes through the axis 314 and the center 430 (as it does in FIG. 6) then the total value of the eccentric dimension 434 is added to or subtracted from (it being subtracted in FIG. 6) the radial dimension 335 to determine the radial offset 436. At all other orientations of the line 458 relative to the eccentric dimension 434 the effect on the radial offset 436 is less than the eccentric dimension 434. By altering the radial offset 436, the stroke length 42 of the device 410 can be altered.

Figure 7:
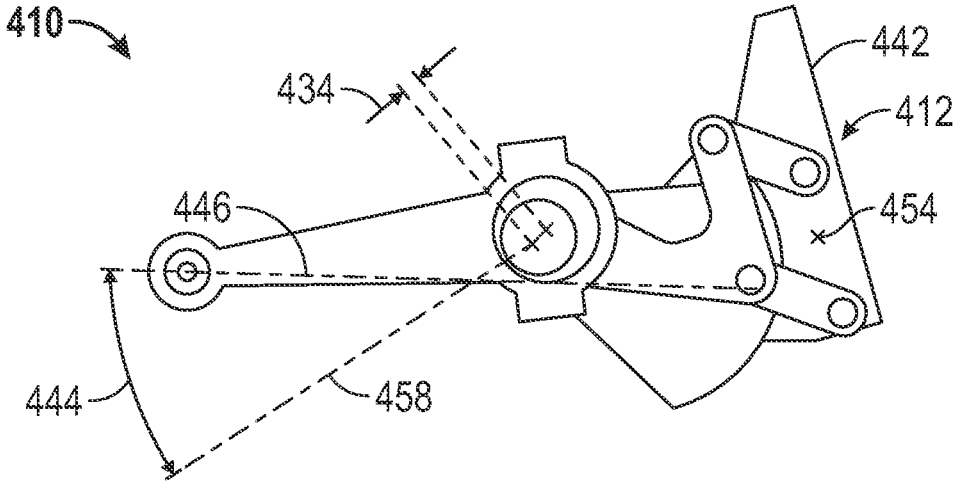
FIG. 7 depicts a view similar to that of FIG. 6 but with the device shown in a different rotational orientation.

Referring to FIG. 7, the device 410 is illustrated with the anchoring point 454 of the linking structure 442 moved relative to its location in FIG. 6. Consequently, the directional orientation 444 of the eccentric dimension 434 is altered thereby changing the radial offset 436 and the stroke length 42 determined thereby.

Referring again to FIGS. 6 and 7 the device illustrated is showing an embodiment to alter the stroke length 42 of the stem 18 in a way that maintains the amount of reciprocating movement constant when turning the main crankshaft 435. The linking structure 442 contains at least one secondary crankshaft lever 448 that rotates in restrained-guided manner with the main crankshaft 435. The restrained-guided rotation may be synchronized to the rotation of the main crankshaft 435 using more than one secondary crankshaft lever 448 and 449. Alternative embodiments could feature as a synchronization device—but not limited to that—a geared link (not shown) between the main crankshaft 435 and the secondary crankshaft 448. Altering the position of the linking structure 442 causes the stem 18 to be retracted or extracted independent of the angular position of the main crankshaft 435 since the directional orientation 444 is maintained while the main crankshaft 435 rotates. This is causing a static offset of the stem 18 with respect to the structure 128.

The embodiments disclosed herein can be used for fluid pulse telemetry in a borehole of a downhole application. Possible downhole applications include hydrocarbon recovery and carbon dioxide sequestration. For example, the devices explained in this application can be used to transmit data from downhole to surface in various ways. It can encode data by adjusting the rotary motion of the drive using frequency, phase or pulse position modulation encoding methods to do so. These methods are exemplary only; combinations thereof as well as other encoding schemes are feasible. Therefore, it is intended that the invention disclosed herein not be limited to one of the particular mentioned methods. For example, such methods include the encoding and transmission schemes described in U.S. Pat. No. 7,417,920 to Hahn et al., issued Aug. 26, 2008, the entire contents of which are incorporated herein by reference.

Figure 8:
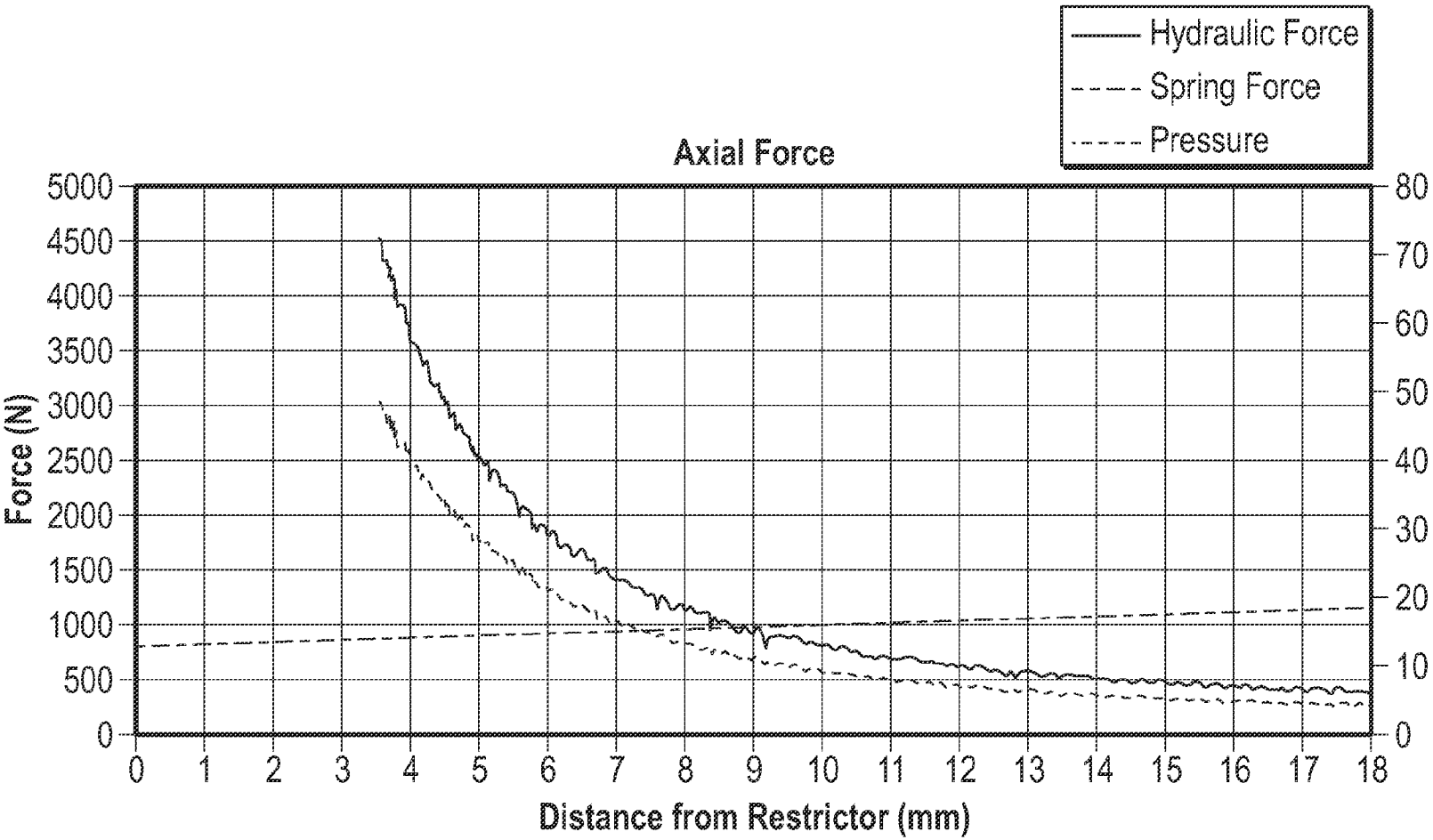
FIG. 8 depicts a graph of force versus distance from a restrictor for the devices disclosed herein.
Figure 9:
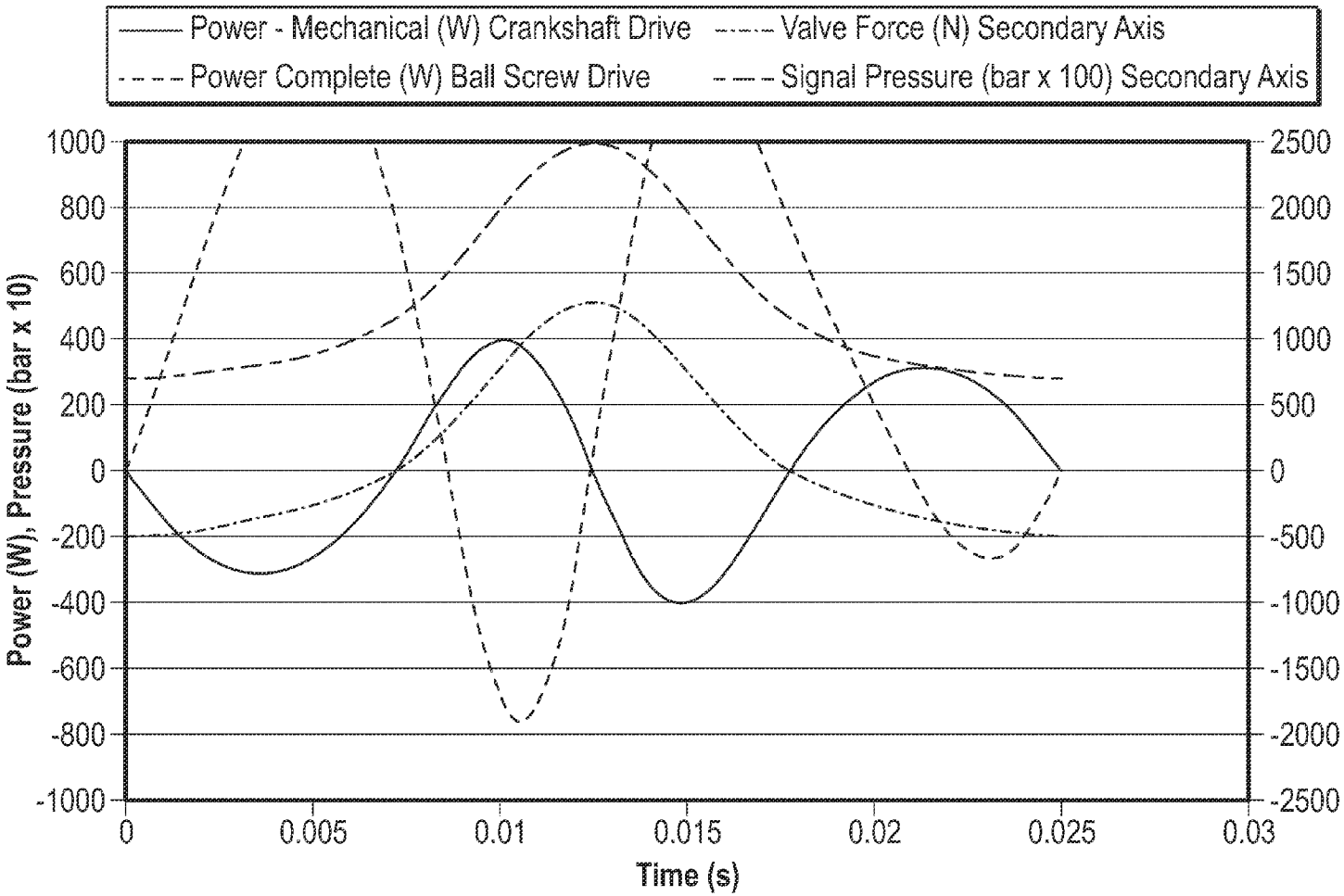
FIG. 9 depicts a graph of power and pressure versus time comparing the devices disclosed herein to a typical ball screw type device.
Figure 10:
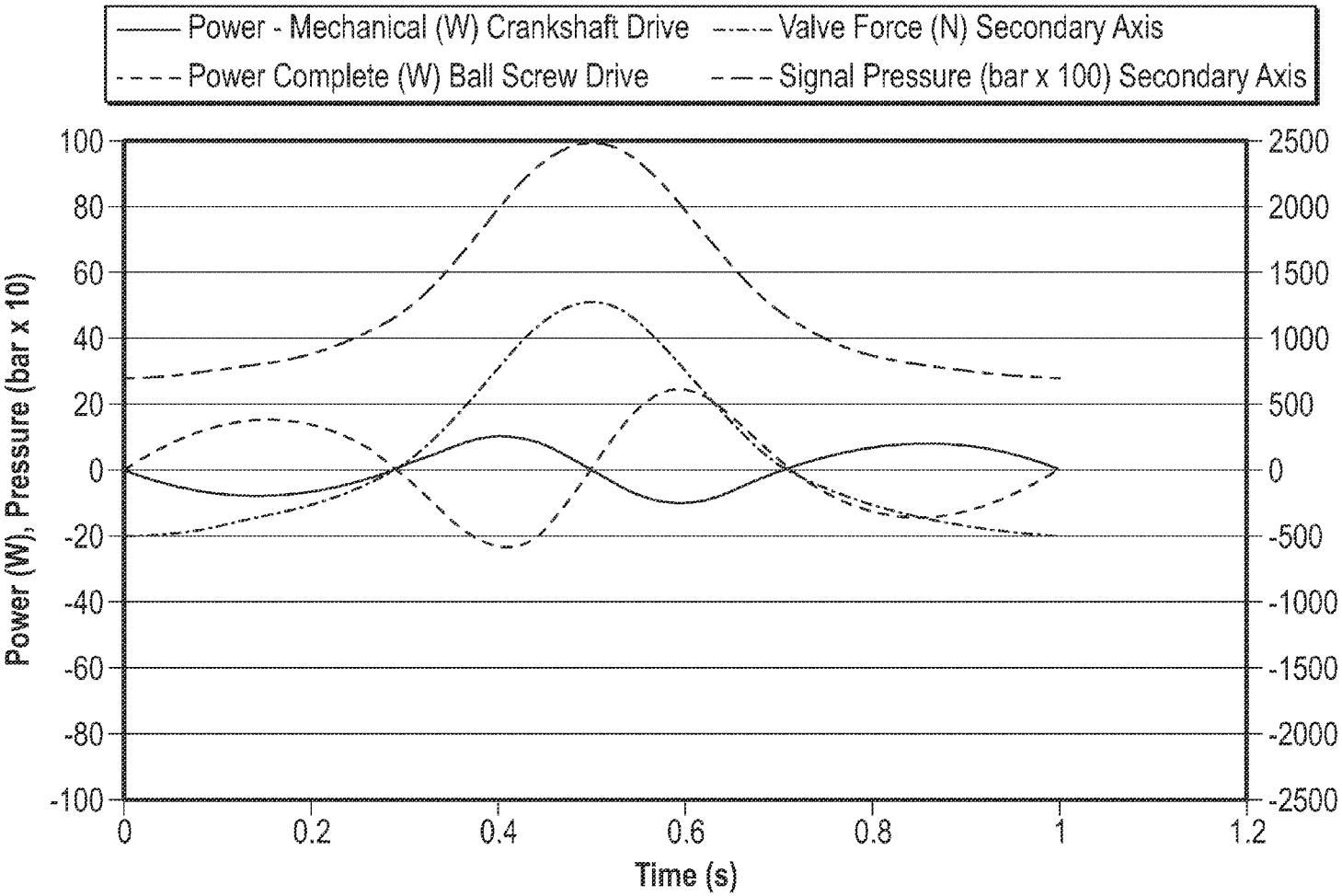
FIG. 10 also depicts a graph of power and pressure versus time comparing the devices disclosed herein to a typical ball screw type device.

Referring to FIGS. 8-10, three graphs are presented comparing performance characteristics of embodiments of the device disclosed herein to a typical motor driven ball screw type device, such as those disclosed in the U.S. Pat. No. 7,417,920 to Hahn et al. FIG. 8 shows Force versus Distance from a restrictor, or the passageway 22, for the devices 10, 110, 210 and 310 disclosed herein. The graph highlights the significant forces that are generated near TDC as the Distance from the restrictor (passageway) decreases. The spring force sketched in FIG. 8 may be used to reduce the overall force and power required to operate such devices. FIG. 9 shows Power and Pressure versus Time for the devices 10, 110, 210 and 310 and Power versus Time for a ball screw drive type device operated at high frequency, 40 Hz being illustrated. The graph shows that the ball screw type device requires nearly three times the power to operate than the devices 10, 110, 210 and 310 disclosed herein. FIG. 10 shows that even at low frequencies, 1 Hz being illustrated, the power to operate the devices 10, 110, 210 and 310 is still less than that for a ball screw type device.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A device for generating pressure pulses in flowing fluid comprising:

a valve having a stem movable linearly relative to a passageway, the valve being configured to vary restriction to flow through the passageway in response to changes in relative position between the stem and the passageway;

a rotatable member in operable communication with the valve such that rotation of the rotatable member causes the stem to move; and a motion translation arrangement being in operable communication with the rotatable member and the stem such that the stem linearly reciprocates in response to the rotatable member rotating in a single direction of rotation.

2. The device for generating pressure pulses in flowing fluid of claim 1, wherein the motion translation arrangement is configured to adjust a stroke length of the linear movement of the stem.

3. The device for generating pressure pulses in flowing fluid of claim 1, wherein the motion translation arrangement is configured to adjust a maximum restriction condition of the device.

4. The device for generating pressure pulses in flowing fluid of claim 1, wherein the motion translation arrangement is configured to adjust automatically.

5. The device for generating pressure pulses in flowing fluid of claim 1, wherein the motion translation arrangement is configured to be adjusted by an operator.

6. The device for generating pressure pulses in flowing fluid of claim 1, wherein a maximum restriction of the valve occurs when the rotatable member is at or near one of top-dead-center and bottom-dead-center.

7. The device for generating pressure pulses in flowing fluid of claim 1, wherein an axis of rotation of the rotatable member is substantially perpendicular to the linear movement of the stem.

8. The device for generating pressure pulses in flowing fluid of claim 1, wherein an axis of rotation of the rotatable member is substantially parallel to the linear movement of the stem.

9. A method of generating pressure pulses in flowing fluid, comprising:

rotating a rotatable member about an axis in a single direction of rotation;

reciprocating a stem linearly with the rotation;

varying restriction to flow through a passageway with the stem;

adjusting a motion translation arrangement; and altering a maximum restriction to flow.

10. The method of generating pressure pulses in flowing fluid of claim 9, wherein the altering of the maximum restriction includes changing a radial offset of the rotatable member.

11. The method of generating pressure pulses in flowing fluid of claim 10, wherein the changing of the radial offset includes altering alignment of an eccentric dimension relative to a dimension that defines the radial offset.

12. The method of generating pressure pulses in flowing fluid of claim 9 wherein the altering of the maximum restriction is done without altering a stroke length of the reciprocating movement of the stem.

13. The method of generating pressure pulses in flowing fluid of claim 9, wherein the reciprocating of the stem linearly is in directions substantially perpendicular to a rotational axis of the rotatable member.

14. The method of generating pressure pulses in flowing fluid of claim 9, further comprising varying a stroke length of the reciprocating movement of the stem.

15. The method of generating pressure pulses in flowing fluid of claim 9, further comprising varying a stroke length of the reciprocating movement by adjusting an effective radial dimension of attachment to the rotatable member of the motion translation arrangement.

16. The method of generating pressure pulses in flowing fluid of claim 9, wherein the reciprocating of the stem includes reciprocating a portion of a motion translation arrangement connecting the rotatable member to the stem in directions substantially parallel to the axis but radially displaced from the axis.

17. The device for generating pressure pulses in flowing fluid of claim 1, wherein the direction of rotation of the rotatable member is reversible.

18. A method of generating pressure pulses in flowing fluid, comprising:

rotating a rotatable member about an axis in a first direction of rotation;

linearly moving a stem in a first direction with the rotation;

rotating the rotatable member about the axis in a second direction of rotation;

linearly moving the stem in a second direction with the rotation;

varying restriction to flow through a passageway with the stem;

adjusting a motion translation arrangement; and altering a maximum restriction to flow.

19. The method of generating pressure pulses in flowing fluid of claim 18, wherein the linearly moving of the stem in the first direction with the rotation has a nonlinear relationship between the rotational movement of the rotatable member and the linear movement of the stem.

* * * * *